US008159133B2

(12) United States Patent
Oh et al.

(10) Patent No.: US 8,159,133 B2
(45) Date of Patent: Apr. 17, 2012

(54) PLASMA DISPLAY PANEL COMPRISING NOISE REDUCING BARRIER RIB STRUCTURE

(75) Inventors: Jaeyoung Oh, Gyoungsangbuk-do (KR); Jiwon Woo, Gyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 17 days.

(21) Appl. No.: 12/744,207

(22) PCT Filed: Nov. 28, 2008

(86) PCT No.: PCT/KR2008/007013

§ 371 (c)(1),
(2), (4) Date: May 21, 2010

(87) PCT Pub. No.: WO2009/088158

PCT Pub. Date: Jul. 16, 2009

(65) Prior Publication Data

US 2010/0283378 A1 Nov. 11, 2010

(30) Foreign Application Priority Data

Jan. 7, 2008 (KR) ..... 10-2008-0001826
Jan. 8, 2008 (KR) ..... 10-2008-0002279

(51) Int. Cl.
*H01J 17/49* (2006.01)

(52) U.S. Cl. ..... 313/586; 313/582; 313/585

(58) Field of Classification Search ..... 313/582–587
See application file for complete search history.

(56) References Cited

U.S. PATENT DOCUMENTS

| | | | | |
|---|---|---|---|---|
| 6,608,441 | B2 * | 8/2003 | Kunii et al. | 313/584 |
| 6,747,409 | B1 * | 6/2004 | Han et al. | 313/582 |
| 7,187,125 | B2 * | 3/2007 | Yoon et al. | 313/582 |
| 7,605,537 | B2 * | 10/2009 | Kim et al. | 313/582 |
| 7,629,745 | B2 * | 12/2009 | Kim | 313/582 |
| 2002/0047519 | A1 * | 4/2002 | Kunii et al. | 313/584 |
| 2002/0163304 | A1 * | 11/2002 | Akiba | 313/584 |
| 2004/0051457 | A1 * | 3/2004 | Kimura et al. | 313/586 |
| 2004/0189171 | A1 * | 9/2004 | Bettinelli et al. | 313/292 |
| 2004/0201350 | A1 * | 10/2004 | Kwon et al. | 313/582 |
| 2005/0001548 | A1 * | 1/2005 | Sawa et al. | 313/582 |
| 2005/0001551 | A1 * | 1/2005 | Kim et al. | 313/584 |
| 2005/0007018 | A1 * | 1/2005 | Akiba | 313/583 |
| 2005/0264205 | A1 * | 12/2005 | Chun et al. | 313/584 |
| 2006/0125396 | A1 | 6/2006 | Han et al. | |
| 2006/0170350 | A1 | 8/2006 | Kim et al. | |
| 2007/0228959 | A1 | 10/2007 | Kang | |

FOREIGN PATENT DOCUMENTS

JP 2007257981 A 10/2007

OTHER PUBLICATIONS

International Search Report dated Feb. 12, 2009 for Application No. PCT/KR2008/007013, 3 pages.

* cited by examiner

*Primary Examiner* — Nimeshkumar Patel
*Assistant Examiner* — Jose M Diaz
(74) *Attorney, Agent, or Firm* — Fish & Richardson P.C.

(57) ABSTRACT

A plasma display panel is disclosed. The plasma display panel includes a front substrate, a rear substrate positioned opposite the front substrate, and a barrier rib that is positioned between the front substrate and the rear substrate to partition discharge cells. The barrier rib includes a transverse barrier rib and a longitudinal barrier rib crossing each other. Depressions are positioned to be spaced apart from each other at a barrier crossing of the transverse barrier rib and the longitudinal barrier rib.

20 Claims, 12 Drawing Sheets

(a)

(b)

[Fig. 1]
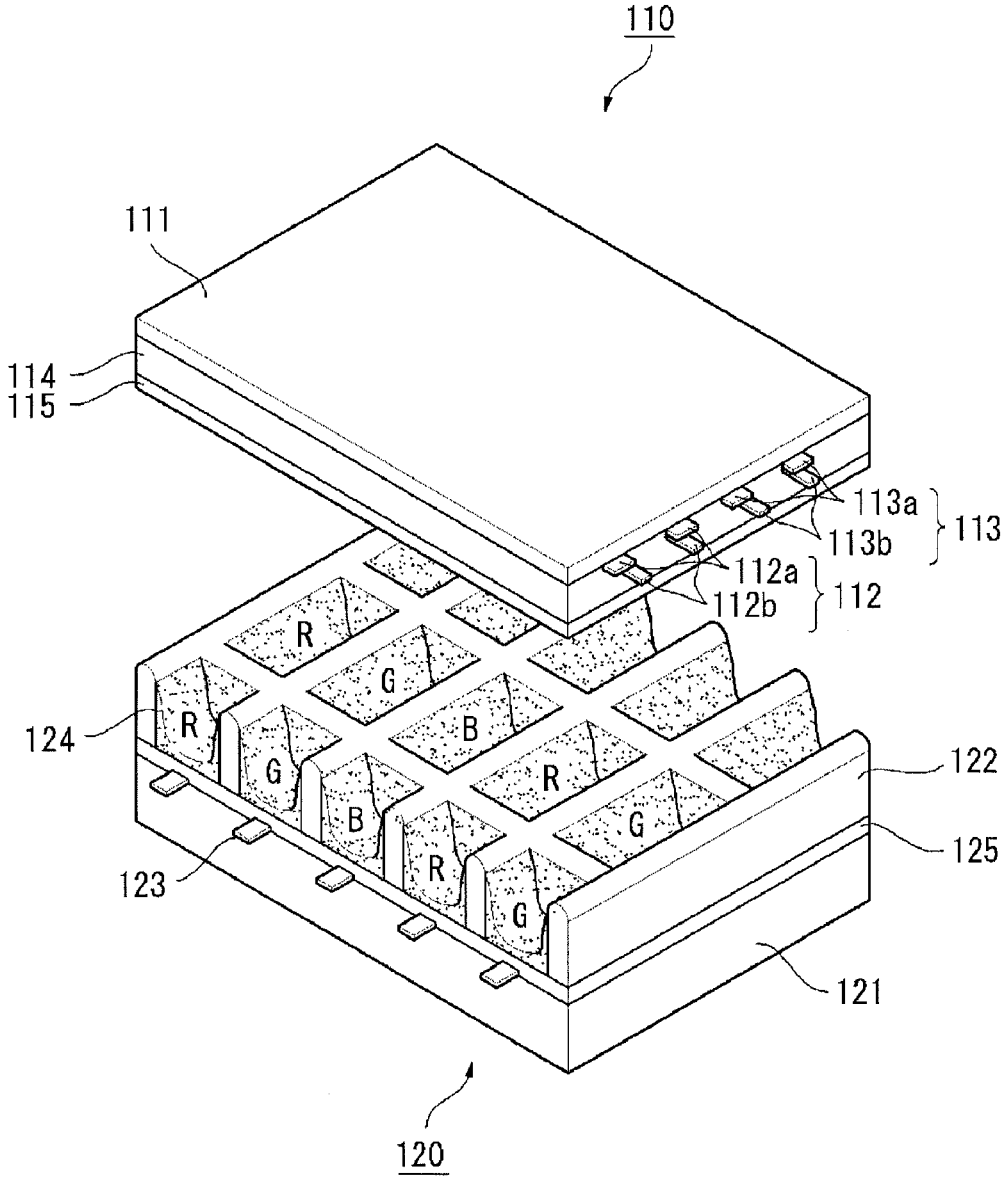

[Fig. 2]
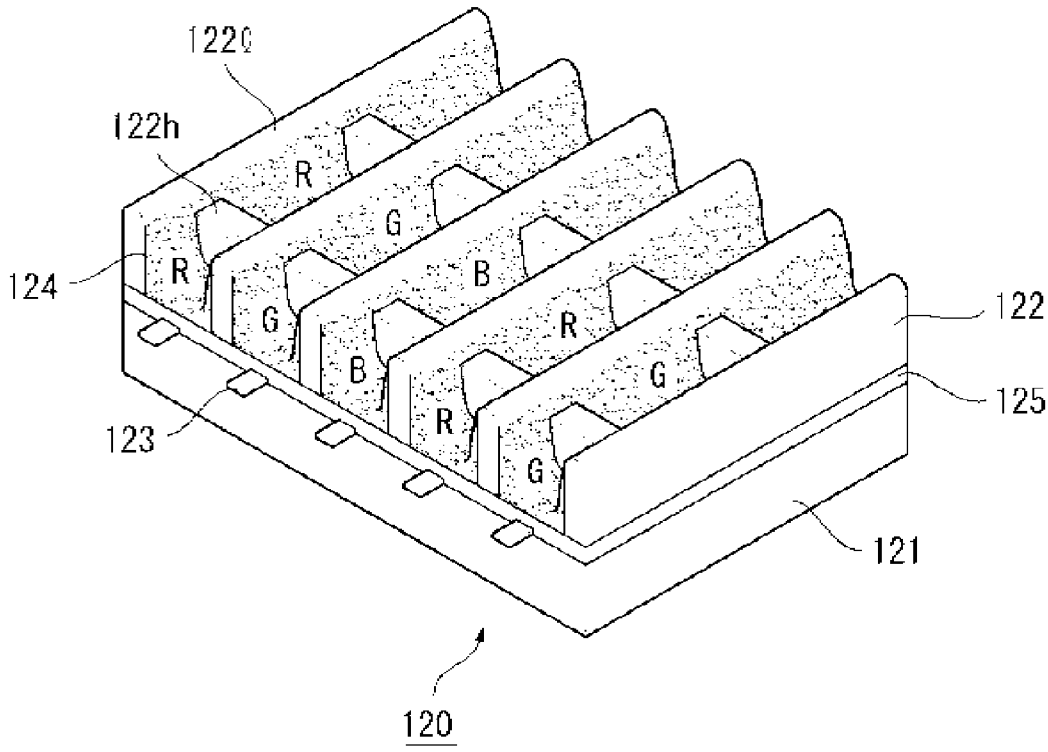

[Fig. 3]
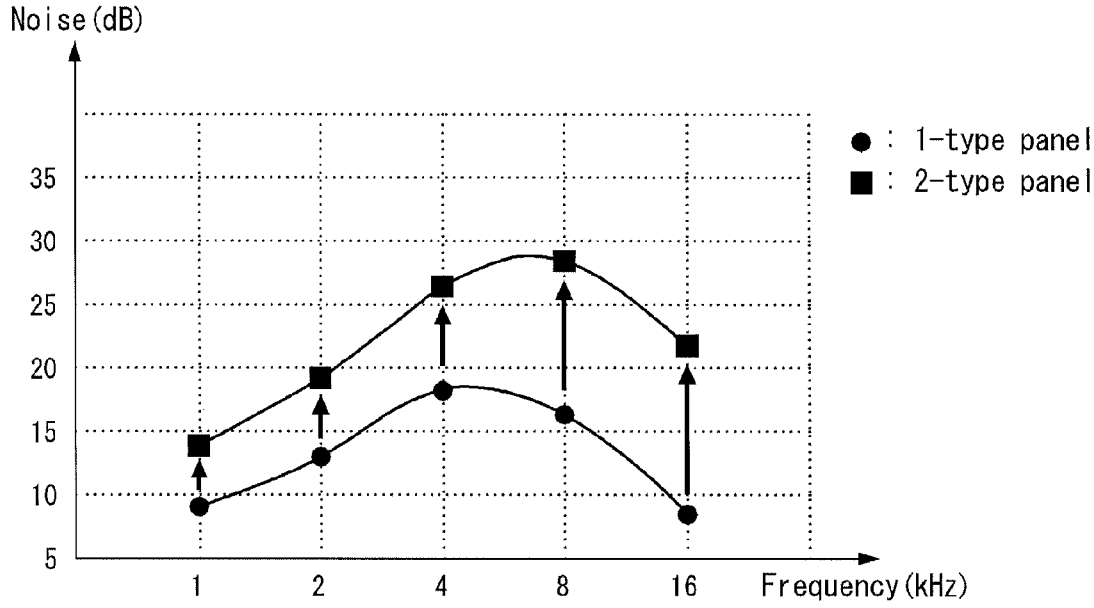
| Frequency (kHz) | noise (dB) | |
|---|---|---|
| | 1-type panel | 2-type panel |
| 1 | 9.8 | 14 |
| 2 | 13.6 | 19 |
| 4 | 17.0 | 26 |
| 8 | 15.3 | 28 |
| 16 | 9.4 | 21 |

[Fig. 4]
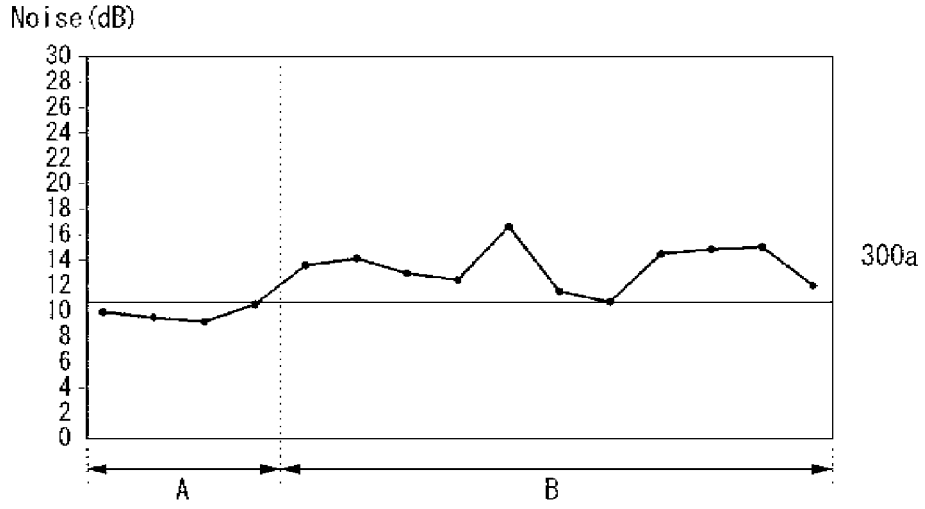
[Fig. 5]
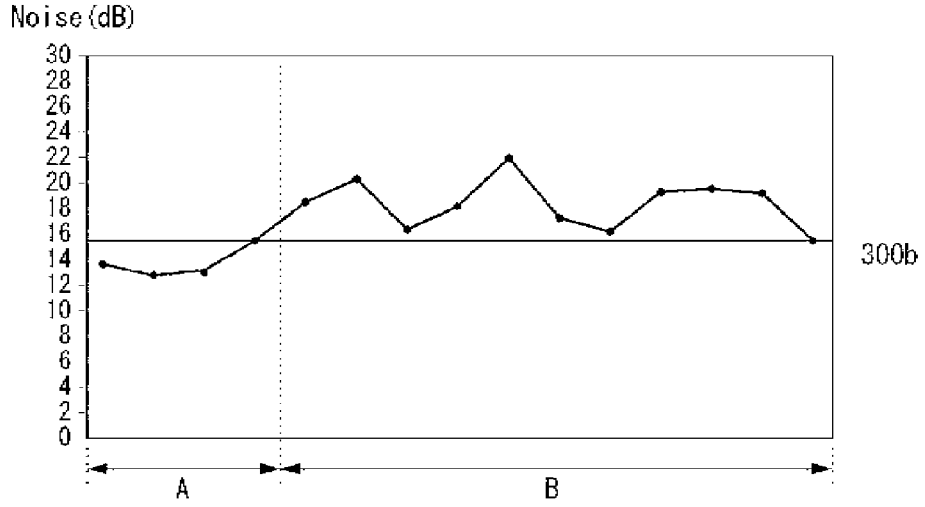
[Fig. 6]
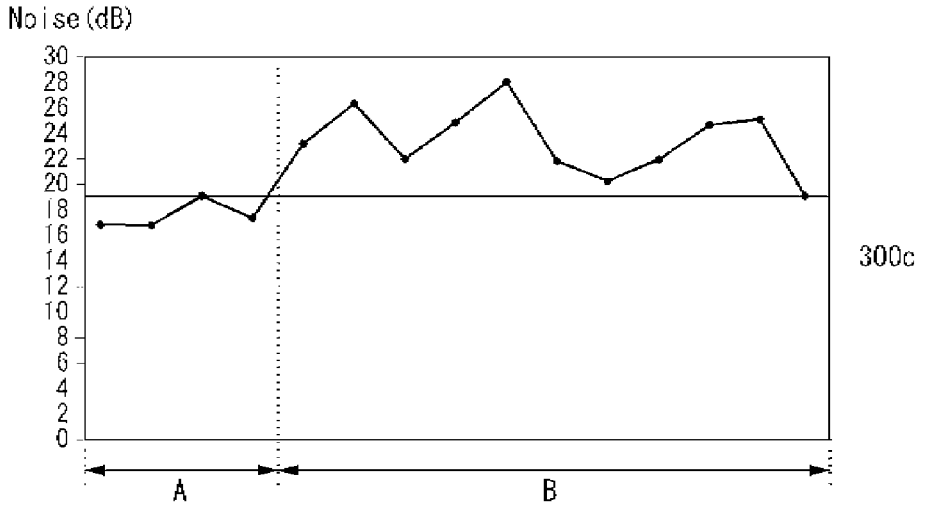

[Fig. 7]
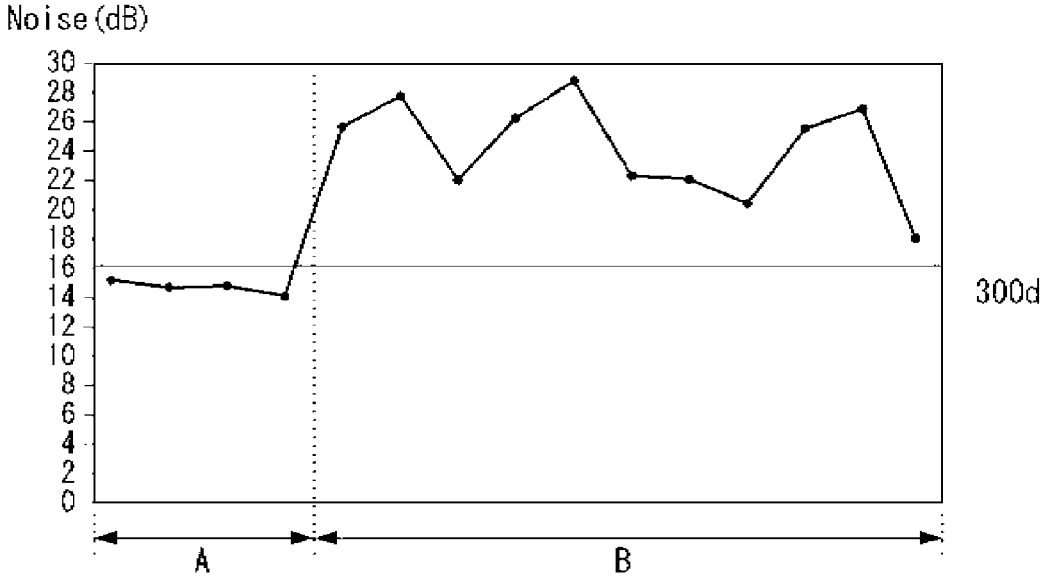
[Fig. 8]
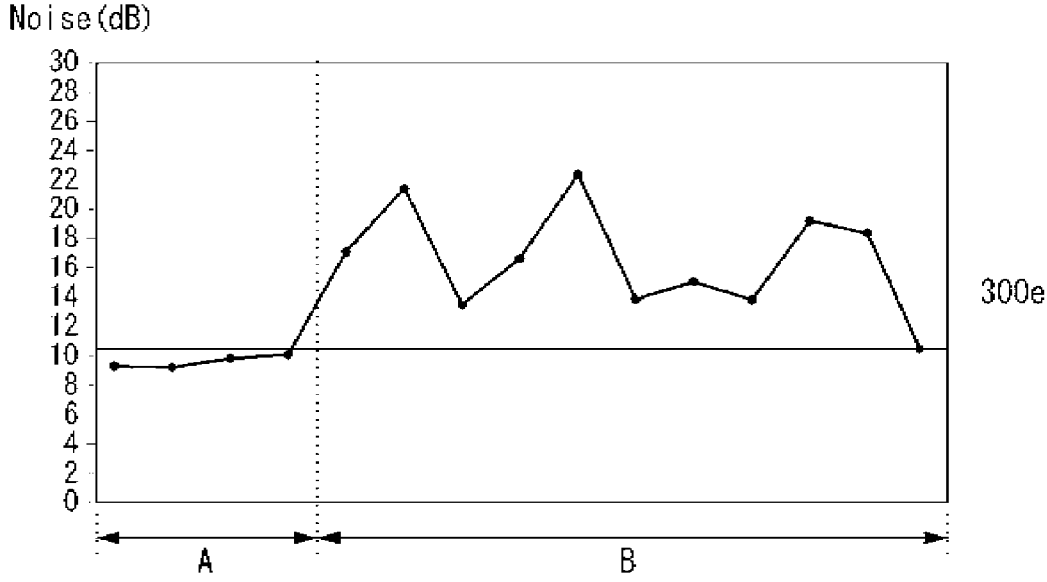

【Fig. 9】
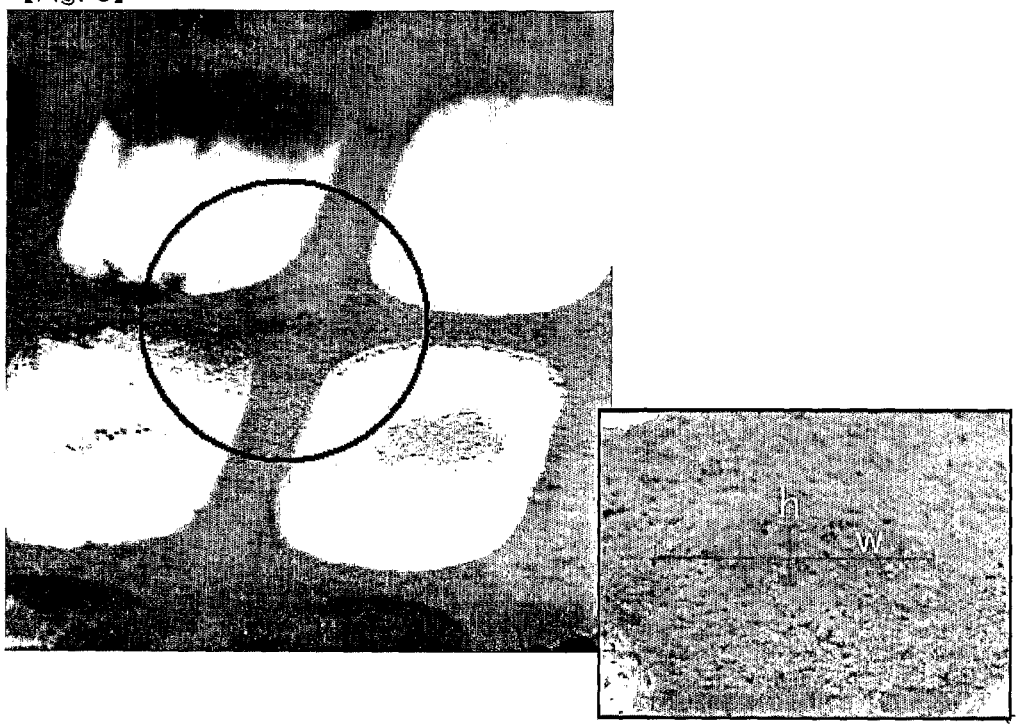
【Fig. 10】
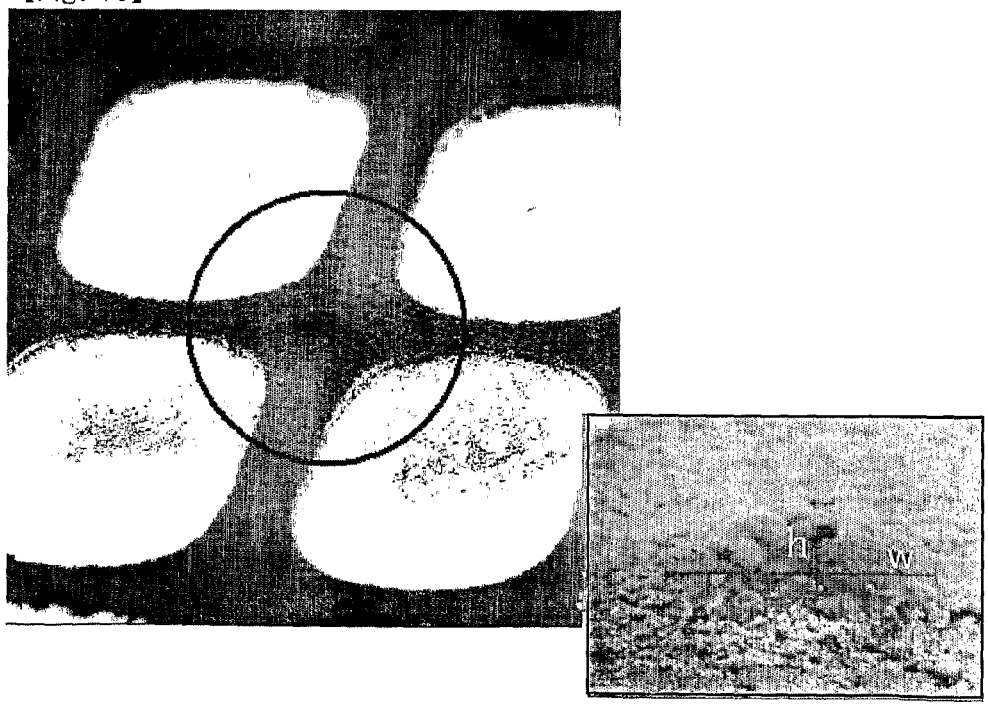

【Fig. 11】
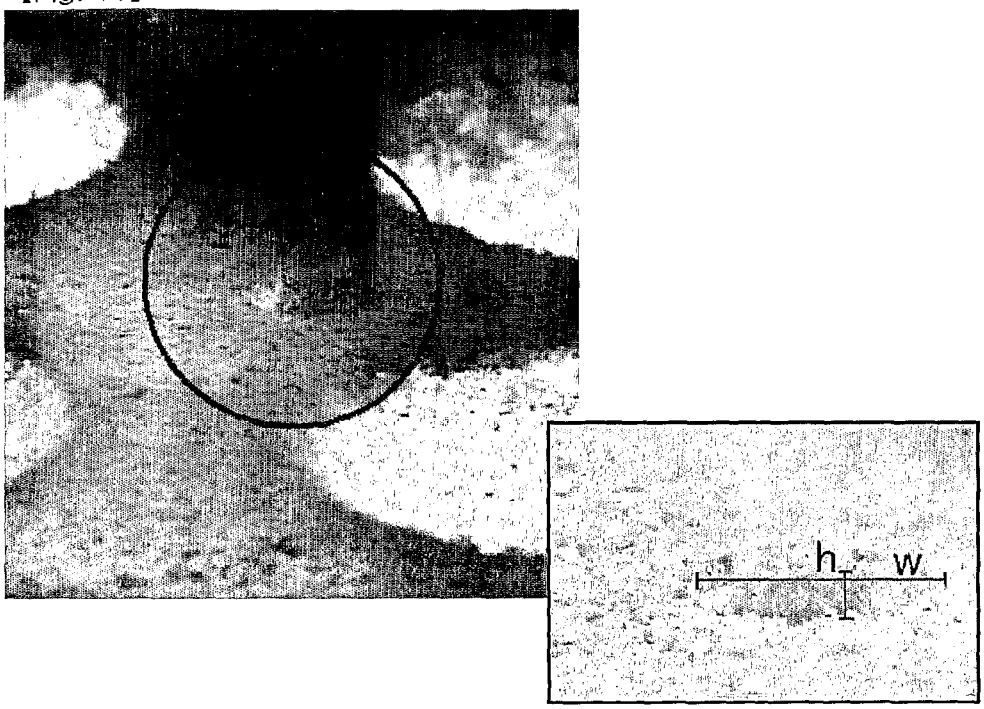
【Fig. 12】
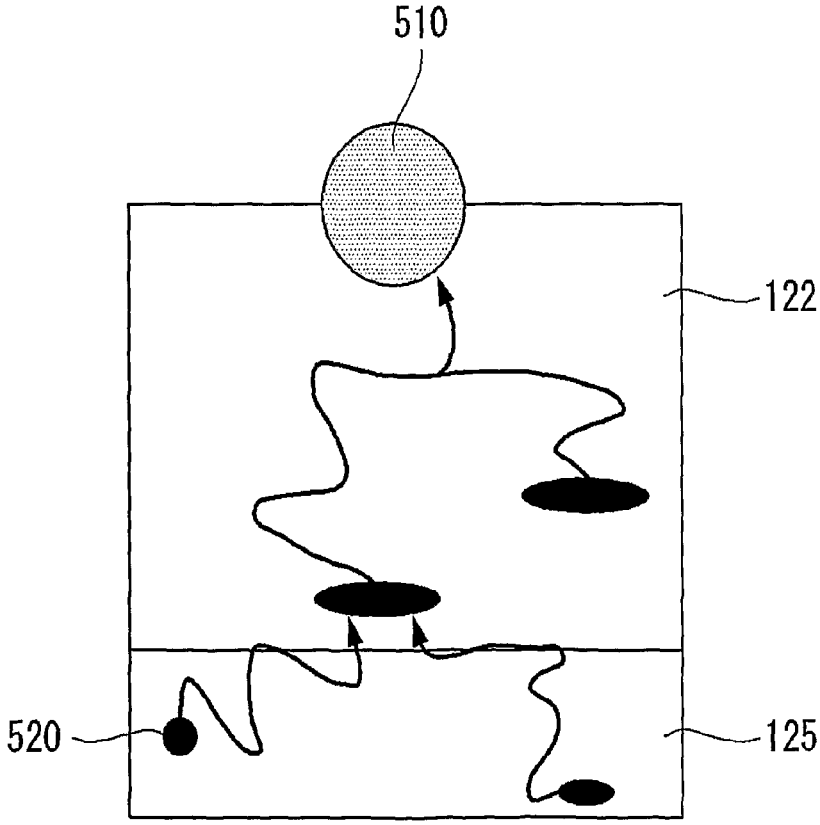

[Fig. 13]
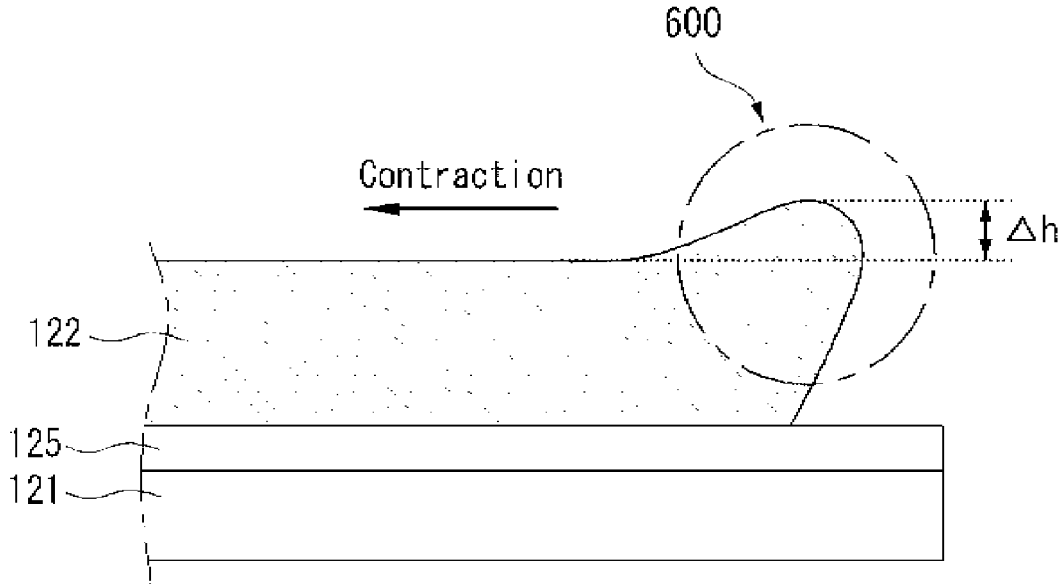

[Fig. 14]
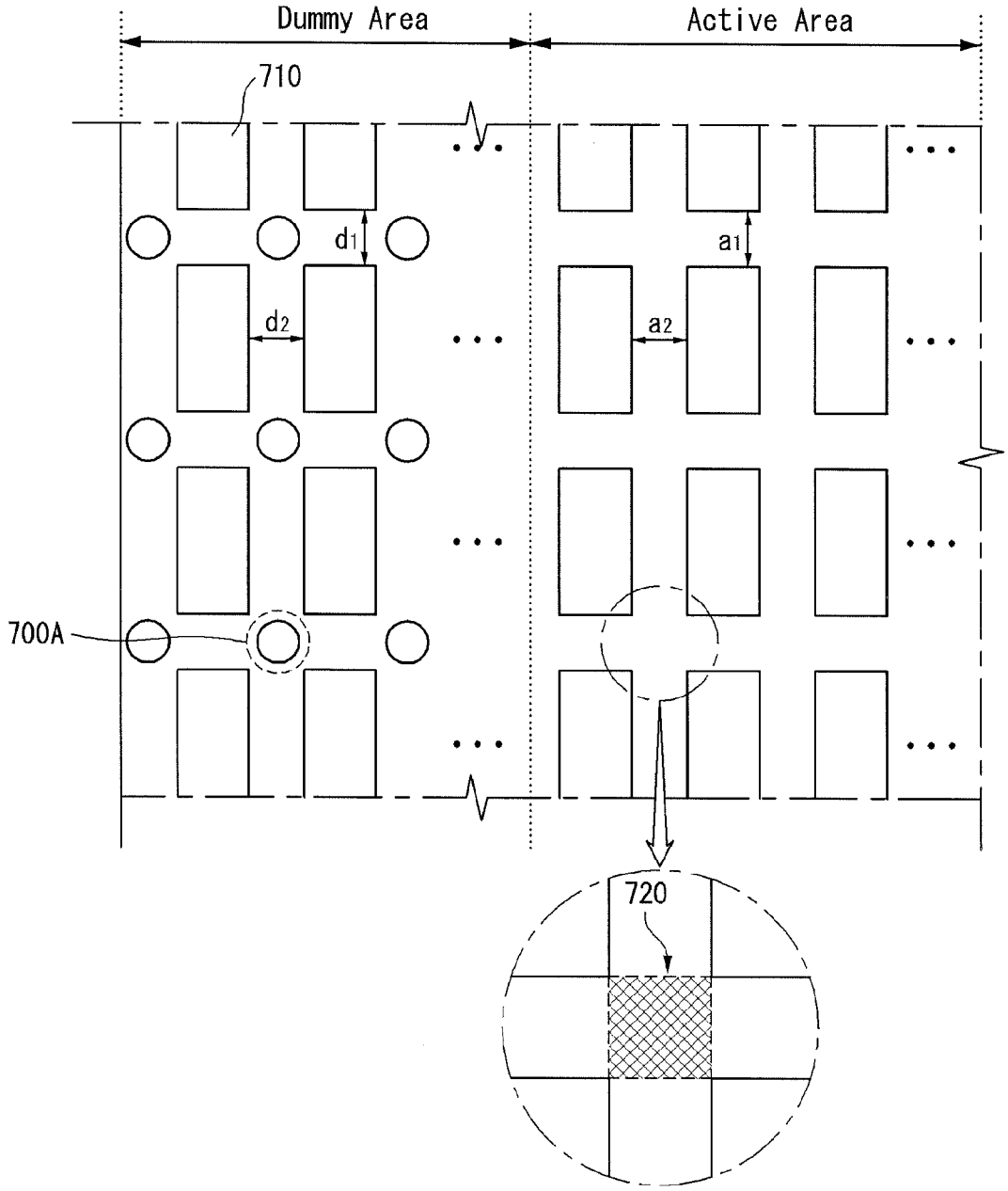

[Fig. 15]
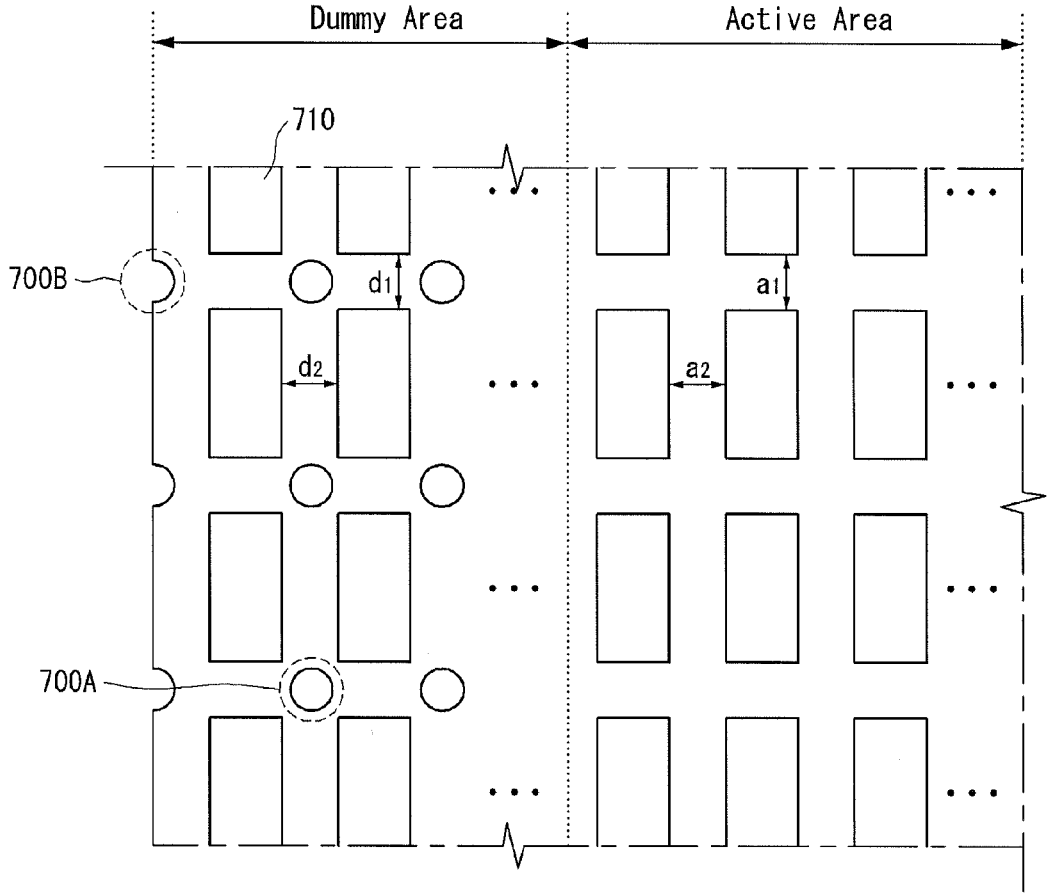

[Fig. 16]
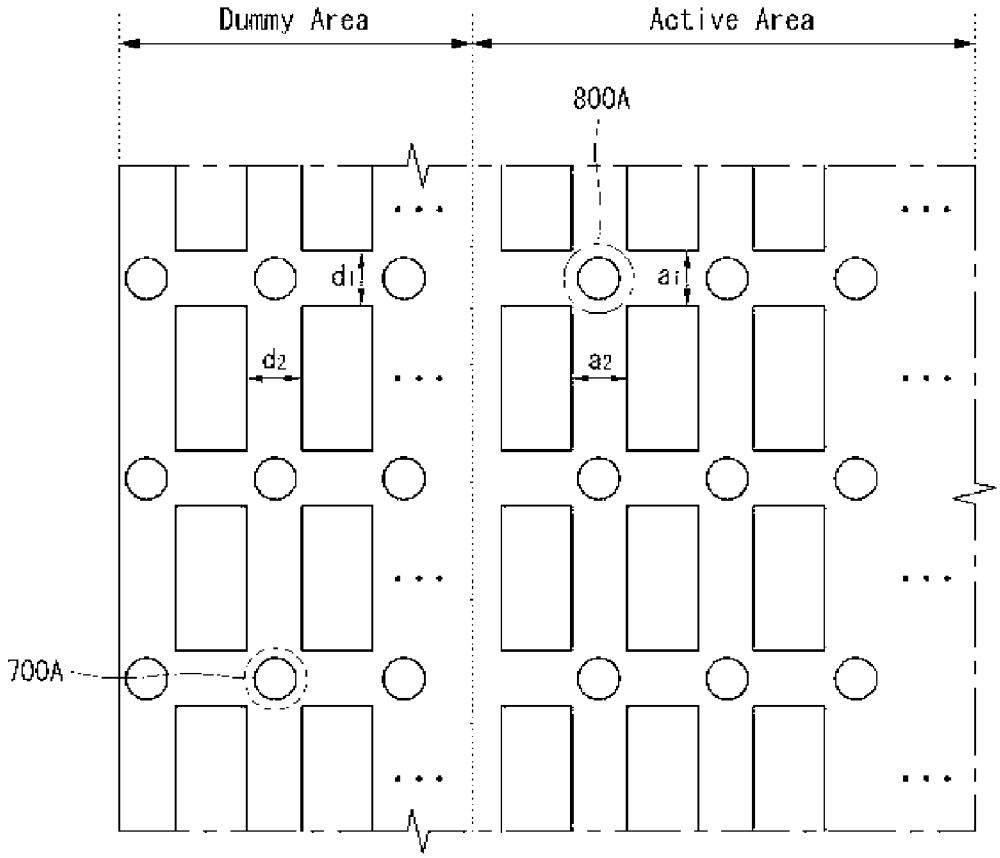

【Fig. 17】
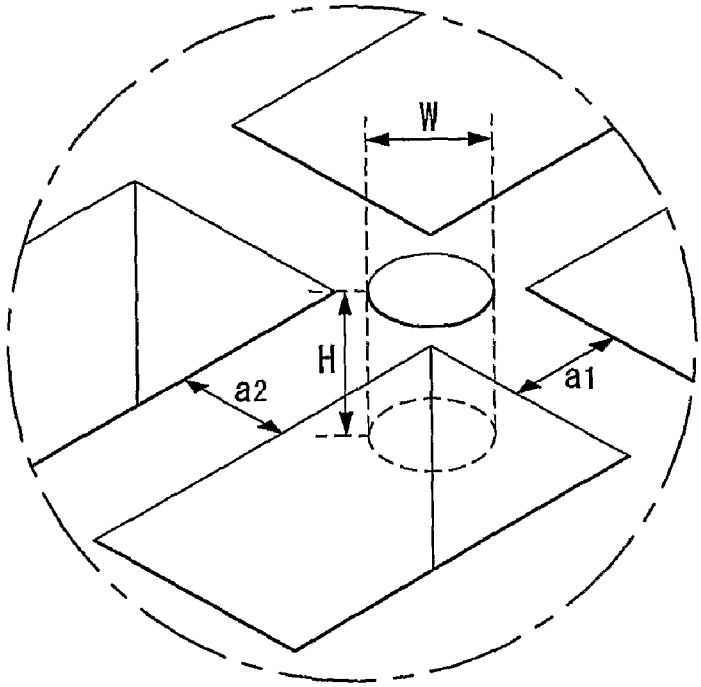
(a)
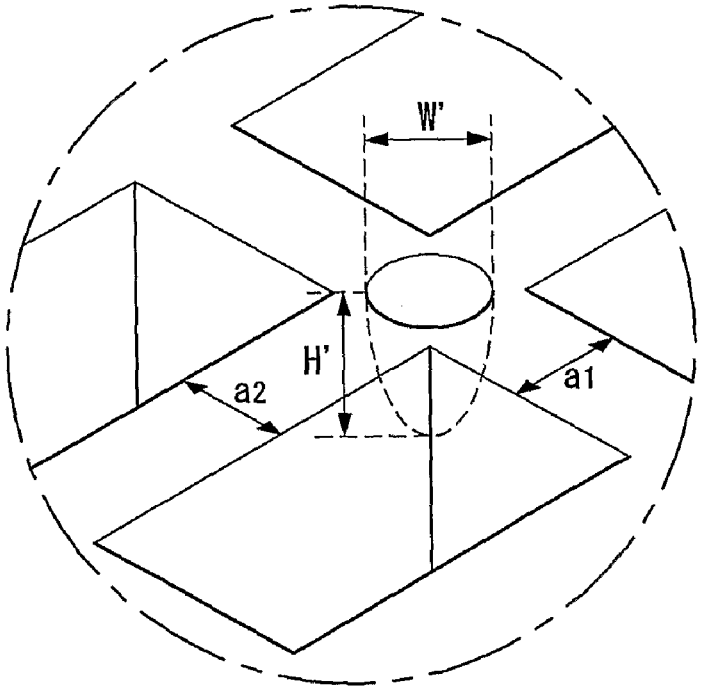
(b)

PLASMA DISPLAY PANEL COMPRISING NOISE REDUCING BARRIER RIB STRUCTURE

TECHNICAL FIELD

Exemplary embodiments relate to a plasma display panel.

BACKGROUND ART

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

DISCLOSURE OF INVENTION

Technical Solution

In one aspect, a plasma display panel comprises a front substrate, a rear substrate positioned opposite the front substrate, and a barrier rib that is positioned between the front substrate and the rear substrate to partition discharge cells, the barrier rib including a transverse barrier rib and a longitudinal barrier rib crossing each other, wherein depressions are positioned to be spaced apart from each other at a barrier crossing of the transverse barrier rib and the longitudinal barrier rib.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention. In the drawings:

FIG. 1 is a perspective view of a plasma display panel according to an exemplary embodiment;

FIG. 2 illustrates a structure of the plasma display panel in which a height of a transverse barrier rib is smaller than a height of a longitudinal barrier rib;

FIGS. 3 to 12 are diagrams for explaining a generation cause of projections at all of crossings between barrier ribs in an active area as well as a dummy area;

FIG. 13 is a diagram for explaining a generation cause of a projection at an end of a barrier rib in a dummy area; and FIGS. 14 to 17 illustrate a method for forming a depression on a barrier rib so as to reduce a noise of the plasma display panel.

MODE FOR THE INVENTION

Reference will now be made in detail embodiments of the invention examples of which are illustrated in the accompanying drawings.

As shown in FIG. 1 which is a perspective view of a plasma display panel according to an exemplary embodiment, the plasma display panel includes a front panel 110 and a rear panel 120.

The front panel 110 includes a front substrate 111, scan electrodes 112, sustain electrodes 113, an upper dielectric layer 114, and a protective layer 115.

The scan electrodes 112 and the sustain electrodes 113 are formed parallel to each other an the front substrate 111. The scan electrode 112 and the sustain electrode 113 each include transparent electrodes 112*a* and 113*a* and bus electrodes 112*b* and 113*b*. The transparent electrodes 112*a* and 113*a* are formed of indium tin oxide (ITO) and diffuse a discharge by a supply of a driving voltage. The bus electrodes 112*b* and 113*b* are formed of a metal material with an excellent electrical conductivity which is easy to mold, for example, silver (Ag), gold (Au), copper (Cu), and aluminum (Al). The scan electrode 112 and the sustain electrode 113 may be bus electrodes in which the transparent electrodes are omitted.

The upper dielectric layer 114 covers the scan electrode 112 and the sustain electrode 113 to provide electrical insulation between the scan electrode 112 and the sustain electrode 113. The protective layer 115 is formed of magnesium oxide (MgO) on the upper dielectric layer 114. The protective layer 115 emits secondary electrons to facilitate an occurrence of a discharge. Further, the protective layer 115 protects the scan electrode 112, the sustain electrode 113, and the upper dielectric layer 114 from sputtering of positive ions.

The rear panel 120 includes a rear substrate 121, barrier ribs 122, address electrodes 123, a phosphor layer 124, and a lower dielectric layer 125.

The address electrodes 123 are formed an the rear substrate 121 to cross the scan electrodes 112 and the sustain electrodes 113. The lower dielectric layer 125 is formed on the address electrodes 123 to provide electrical insulation between the address electrodes 113.

The barrier ribs 122 are formed on the lower dielectric layer 125 to partition discharge cells. For example, first, second, and third discharge cells respectively emitting red light, blue light, and green light may be formed between the front substrate 111 and the rear substrate 121. The discharge cell is formed at each of crossings of the scan electrodes 112, the sustain electrodes 113, and the address electrodes 123. A plane shape of the discharge cell may be a rectangle as shown in FIG. 1.

The phosphor layer 124 is formed inside the discharge cells partitioned by the barrier ribs 122 to emit visible light for an image display during an address discharge.

FIG. 2 illustrates a structure of the plasma display panel in which a height of a transverse barrier rib 122*h* is smaller than a height of a longitudinal barrier rib 122*l*. In FIG. 2, the transverse barrier rib 122*h* is defined as a barrier rib partitioning the discharge cells coated with a phosphor of the same material.

As shown in FIG. 2, because the height of the transverse barrier rib 122*h* partitioning the discharge cells coated with the phosphor of the same material is smaller than the height of the longitudinal barrier rib 122*l*, channel capable of being used as an passage of a gas is formed between the discharge cells coated with the phosphor of the same material. Hence, an exhaust characteristic can be improved.

A method for forming a pattern of the barrier rib 122 includes a sandblasting method, an etching method, and a photosensitive paste method.

The sandblasting method is advantageous in a precision of a barrier pattern, but is disadvantageous in a material loss and waste materials generated after the work. Accordingly, the etching method and the photosensitive paste method have been now used in most of industries. The etching method and the photosensitive paste method are advantageous in a resolution as well as a reduction in process time.

The etching method includes coating a barrier paste on a white back using a printing method, a coating method, or a green sheet method, drying and firing the barrier paste, forming a barrier pattern using a dry film resistor (DFR) or a photoresist (PR), and etching and peeling the barrier pattern.

The photosensitive paste method includes coating a photosensitive paste on a white back using a printing method, a coating method, or a green sheet method, drying and firing the photosensitive paste, exposing and developing the photosensitive paste using a mask, and firing the photosensitive paste.

A noise may be generated in the plasma display panel because of projections on the barrier ribs. The projections may be formed at all of crossings between the barrier ribs in an active area as well as a dummy area and may be formed at ends of the barrier ribs in the dummy area.

The projections at all the crossings between the barrier ribs in the active area may be formed in a process in which a binder, and the like, evaporating in a gas state inside a barrier material is exhausted from an upper portion of the barrier rib. FIGS. 3 to 12 are diagrams for explaining a generation cause of the projections at all the crossings between the barrier ribs in the active area as well as the dummy area.

The projections at the ends of the barrier ribs in the dummy area may be formed because an adhesive power of a lower portion of the barrier material is not sufficiently secured by a contraction generated during a firing process for forming the barrier rib. FIG. 13 is a diagram for explaining a generation cause of a projection at an end of the barrier rib in the dummy area.

FIG. 3 illustrates a result measuring noises generated in 1-type and 2-type plasma display panels. The 1-type and 2-type plasma display panels are distinguished depending on the noise amount.

The 1-type and 2-type plasma display panels are positioned in a dumb room, and a sound level meter is positioned at 1 m ahead of the 1-type and 2-type panels. Then, while the same video data was supplied to the 1-type and 2-type panels, a noise was measured at frequencies of 1 kHz, 2 kHz, 4 kHz, 8 kHz, and 16 kHz.

In (a) of FIG. 3, an X-axis denotes a frequency, and a Y-axis denotes a noise at each frequency.

As shown in FIG. 3, in the 1-type plasma display panel, noises of 9.8 dB, 13.6 dB, 17.0 dB, 15.3 dB, and 9.4 dB were respectively measured at frequencies of 1 kHz, 2 kHz, 4 kHz, 8 kHz, and 16 kHz. A noise of the 1-type plasma display panel at all of frequency bands is about 21 dB. The noise value is a normal noise value capable of being generally generated during a drive of the plasma display panel.

In the 2-type plasma display panel, noises of 14 dB, 19 dB, 26 dB, 28 dB, and 21 dB were respectively measured at frequencies of 1 kHz, 2 kHz, 4 kHz, 8 kHz, and 16 kHz. A noise of the 2-type plasma display panel at all of frequency bands is about 29 dB.

It can be seen from FIG. 3 that the noise of the 2-type panel is larger than the noise of the 1-type panel at all the frequencies. Further, when the noise of the 2-type panel was measured after the sound level meter is positioned close to the 2-type panel, a noise of 40 to 50 dB was measured at all the frequencies. Accordingly, a noise failure may be generated in the entire portion of the 2-type panel.

FIGS. 3 to 8 are graphs showing a result measuring noises of a 1-type panel group A including a plurality of 1-type panels and a 2-type panel group B including a plurality of 2-type panels at frequencies of 1 kHz, 2 kHz, 4 kHz, 8 kHz, and 16 kHz. More specifically, FIG. 4 shows the noise at 1 kHz, FIG. 5 shows the noise at 2 kHz, FIG. 6 shows the noise at 4 kHz, FIG. 7 shows the noise at 8 kHz, and FIG. 8 shows the noise at 16 kHz.

In FIGS. 3 to 8, a horizontal line denotes a normal noise threshold value of a corresponding frequency, and a vertical dotted line denotes a line for distinguishing the 1-type panel group A from the 2-type panel group B.

As shown in FIGS. 3 to 8, the noise of the 1-type panel group A is smaller than normal noise threshold values 300*a*, 300*b*, 300*c*, 300*d*, and 300*e*. The noise of the 2-type panel group B is larger than the normal noise threshold values 300*a*, 300*b*, 300*c*, 300*d*, and 300*e*.

As shown in FIG. 4, the noise of the 2-type panel group B increases by about 4 dB from the noise of the 1-type panel group A at 1 kHz. As shown in FIG. 5, the noise of the 2-type panel group B increases by about 5 dB from the noise of the 1-type panel group A at 2 kHz. As shown in FIG. 6, the noise of the 2-type panel group B increases by about 9 dB from the noise of the 1-type panel group A at 4 kHz. As shown in FIG. 7, the noise of the 2-type panel group B increases by about 13 dB from the noise of the 1-type panel group A at 8 kHz. As shown in FIG. 8, the noise of the 2-type panel group B increases by about 10 dB from the noise of the 1-type panel group A at 16 kHz.

In particular, in an atmospheric pressure, a pattern in which the noise of the 2-type panel group B increases by about 10 dB from the noise of the 1-type panel group A at a frequency band of 4 to 16 kHz is different from a pattern in which a noise increases due to an increase in an altitude.

More specifically, because an external pressure of the panel is relatively smaller than an internal pressure of the panel as a height above sea level increases, an altitude noise is generated by projecting the end of the barrier rib.

On the other hand, it may be assumed that a cause of an increase in the noise of the 2-type panel group B at all the frequency bands (particularly, at 4 kHz to 16 kHz) in the atmospheric pressure is different from the above cause of the altitude noise.

FIGS. 9 to 11 are diagrams photographing an upper portion of a barrier rib (i.e., a crossing between the barrier ribs) of the type-2 panel using an electron microscope for finding a cause of a noise failure.

It can be seen from FIGS. 9 to 11 that a projection is formed around the crossing between the barrier ribs.

As shown in FIG. 9, a maximum height h and a maximum width w of a projection are 17 μm and 78 μm, respectively. As shown in FIG. 10, a maximum height h and a maximum width w of a projection are 12 μm and 62 μm, respectively. As shown in FIG. 11, a maximum height h and a maximum width w of a projection are 8 μm and 46 μm, respectively.

Although it is not shown, it was measured from another photographs of the projection at the crossing between the barrier ribs that the maximum height h and the maximum width w of the projection was (15 μm and 70 μm), (4 μm and 40 μm), (17 μm and 78 μm), (12 μm and 77 μm), (3 μm and 30 μm), (8 μm and 32 μm), (10 μm and 39 μm), and the like.

Accordingly, the maximum height of the projection was measured within the range of 4 μm to 17 μm, and the maximum width of the projection was measured within the range of 30 μm to 78 μm.

It may be seen that the noise is generated due to a contact vibration between the front and rear panels of the plasma display panel during a drive of the plasma display panel in the atmospheric pressure because of the projection on the barrier rib of the 2-type panel.

Because the front and rear panels are not closely attached to each other due to the projection on the barrier rib, the contact vibration between the front and rear panels becomes stronger and an intensity of the contact vibration increases. Hence, an intensity of the noise increases.

The intensity of the noise of the 2-type panel is lager than the intensity of the noise of the 1-type panel over the entire area at all the frequency bands. The cause of the noise of the 2-type panel is because of the projection on the barrier rib.

It was observed from FIG. 10 than a small pore is formed on the projection A formation cause of the small pore will be described with reference to FIG. 12.

FIG. 12 is a diagram for explaining a formation cause of the projection and the small pore on the projection.

Because a barrier coating layer is fired and then is etched in the chemical etching method unlike the sandblasting method, an isotropic etching is obtained in the chemical etching method.

In the chemical etching method, a thick film for the barrier rib is formed on the rear substrate 121 on which the electrodes and the lower dielectric layer 125 are formed. The thick film is formed by printing a paste including a barrier material or laminating green sheets.

Then, the thick film passes through a fire furnace, and thus a firing process is performed. The thick film decomposes and exhausts an organic component contained in the paste or the green sheet during the firing process to thereby make the barrier materials dense.

Because the barrier coating layer is thicker than the electrode or the dielectric layer, a drying process has to be carefully performed. More specifically, when the drying process is rapidly performed on the thick barrier coating layer, the surface of the barrier coating layer becomes hard. Therefore, a solvent remains inside the barrier coating layer, and then changes in a foam state in a succeeding firing process. Hence, a reduction of the quality is caused. Accordingly, the drying process has to be slowly performed on the barrier coating layer over a plenty of time.

A dry film resist (DFR) is laminated and coated on the fired thick film, and exposure and development processes are performed on the DFR using a photomask. A protective layer required to form a pattern during an etching of an aqueous solution is formed.

A substrate on which the DFR patterned in conformity with a shape of the barrier rib is coated is exposed to an etching solution and is etched. Then, the protective layer is removed, and a process for manufacturing the barrier rib is completed.

In the sand blasting method, because the barrier rib is fired after the barrier rib is etched and patterned, a binder, a moisture, and the like, vaporized in a gas state inside the barrier material during a firing process are easily exhausted from a lower surface and a side surface of the barrier rib. However, because the barrier coating layer is first fired in the etching method, the binder, the moisture, and the like, are exhausted from only a coating surface of the coating layer.

Accordingly, after the gas inside the coating layer is sufficiently exhausted by slowly performing the firing process, the surface of the coating layer has to be dense.

As shown in FIG. 12, when the barrier rib 122 and the lower dielectric layer 125 are simultaneously fired using the etching method, a projection 510 may be formed on the barrier rib 122 in a process in which a binder 520, and the like, vaporized in a gas state inside the barrier material is exhausted from the coating surface.

A small pore on the projection 510 may be formed by perforating the coating surface in the process in which the binder 520 is exhausted from the coating surface.

The 1-type and 2-type panels may be distinguished whether or not the projection is formed depending on a drying condition, a firing condition (for example, a firing time and a firing temperature), a drying time of the green sheet, and the like.

FIG. 13 is a side view showing a projection of the barrier rib by a contraction generated during the firing process for forming the barrier rib.

The barrier pattern is generally formed through the exposure and development processes, and then the barrier pattern is completed through the firing process.

In order to form the barrier rib 122, a paste including a barrier material is coated on the lower dielectric layer 125 and is patterned in a predetermined shape. Then, the firing process for volatilizing a volatile substance is performed on the barrier pattern The volatile substance contained in the barrier material during the firing process is volatilized and the barrier rib 122 is contracted.

If the barrier rib 122 is contracted through the firing process, a length of the barrier rib 122 is shortened. Hence, a compressive stress occurs by the contraction.

As the barrier rib 122 is far from the inside of the panel, the compressive stress increases. Hence, the compressive stress has a maximum value in the barrier rib of the dummy area positioned outside the active area. Because the compressive stress generates an anisotropic force in one direction, an excitation phenomenon occurs in the barrier rib of the dummy area to thereby form a projection 600.

When the plasma display panel in which the projection 600 is formed on the barrier rib is manufactured, a crack occurs between the front panel and the barrier rib due to the projected barrier rib.

When a high frequency driving voltage is applied, the plasma display panel is vibrated by a shock wave that is generated inside the discharge cell depending on a discharge. Further, the front panel periodically collides with the barrier rib in the crack, and thus the noise is generated in the plasma display panel.

FIGS. 14 to 17 illustrate a method for forming a depression on the barrier rib so as to reduce a noise of the plasma display panel.

FIGS. 14 and 15 illustrate a method for forming a depression at the crossing between the barrier ribs in the dummy area and in an outermost barrier rib correspondingly to FIG. 13. FIGS. 16 and 17 illustrate a method for forming a depression at the crossing between the barrier ribs in the active area as well as the dummy area correspondingly to FIGS. 3 to 12.

As shown in FIG. 14 showing a barrier pattern of the rear substrate, the panel is divided into an active area capable of representing a gray level and a dummy area outside the active area. The dummy area cannot represent the gray level. The barrier rib 122 partitions discharge cells 710 corresponding to crossings of the electrodes.

The outermost barrier rib is positioned in an outermost portion of the dummy area. A transverse barrier rib a1 and a longitudinal barrier rib a2 in the active area cross each other, and a transverse barrier rib d1 and a longitudinal barrier rib d2 in the dummy area cross each other.

A plurality of depressions are positioned to be spaced apart from each other on the transverse barrier rib d1 of the dummy area. Hence, a volume of the barrier material is reduced, and a projection of the barrier material can be minimized.

In the exemplary embodiment, the depression is formed by passing from a specific portion of an upper portion of the barrier rib to a lower portion of the barrier rib contacting the lower dielectric layer. Further, the depression is formed by depressing a portion of the upper portion of the barrier rib.

Because the non-uniformity of a contractile force is maximum in a portion where the transverse barrier rib d1 and the longitudinal barrier rib d2 of the dummy area cross each other, a depression 700A is preferably formed around a crossing between the barrier ribs of the dummy area.

It is preferable that the depression 700A has enough size to be included in the crossing between the barrier ribs of the dummy area. A shape of the depression 700A may be an atypical shape as well as a circle, an oval, a polygon such as a triangle, a pentagon and a hexagon.

Although it is not shown, the depressions 700A may be added between crossings 720 at a constant distance as well as the crossing 720 between the barrier ribs. The depression 700A may be formed every other crossings 720.

As shown in FIG. 15 illustrating another implementation of the formation method of the barrier rib, a plurality of depressions 700A are formed at a constant distance in the remaining portion except an outermost barrier rib among crossings between the barrier ribs of the dummy area. A depression 700B depressed in a direction of the active area is formed in the outermost barrier rib of the dummy area to thereby minimize the projection of the barrier material.

As shown in FIG. 16 illustrating a barrier pattern of the rear substrate of the plasma display panel, the panel is divided into an active area capable of representing a gray level and a dummy area outside the active area. The dummy area cannot represent the gray level. The barrier rib 122 partitions discharge cells 710 corresponding to crossings of the electrodes.

A transverse barrier rib a1 and a longitudinal barrier rib a2 in the active area cross each other, and a transverse barrier rib d1 and a longitudinal barrier rib d2 in the dummy area cross each other.

A plurality of depressions 700A are positioned to be spaced apart from each other at crossings of the transverse barrier ribs a1 and the longitudinal barrier ribs a2 of the active area and at crossings of the transverse barrier ribs d1 and the longitudinal barrier ribs d2 of the dummy area. When the barrier rib 122 and the lower dielectric layer 125 are simultaneously fired, a binder vaporized in a gas state inside the barrier material provides an exhaust passage. Hence, a projection can be prevented from being formed on the barrier rib.

Considering that the projection is formed at the crossing between the barrier ribs, it is preferable that the depression are formed inside the crossings of the transverse barrier ribs a1 and d1 and the longitudinal barrier ribs a2 and d2 or in the center of the crossings.

Although it is not shown, the depression may be added between the crossings at a constant distance as well as the crossings.

FIG. 17 illustrates a depth, a width, and a shape of a projection.

Considering that a shape of the projection on the barrier rib is a spire, a bell, or a flat shape and a bottom surface of the projection is a shape with a predetermined curvature, it is preferable that a bottom surface of the depression is a shape with a predetermined curvature.

The depression has a cylindrical shape whose a bottom surface has a predetermined curvature in (a) of FIG. 17. The depression has a conic shape whose a bottom surface has a predetermined curvature in (b) of FIG. 17.

Because the maximum height of the projection was within the range of 4 μm to 17 μm and the maximum diameter of the projection was within the range of 30 μm to 78 μm with reference to FIGS. 9 to 11, a maximum depth and a maximum width of the projection may be 4 μm to 17 μm and 30 μm to 78 μm, respectively.

A maximum depth H of the cylinder-shaped depression in (a) of FIG. 17 and a maximum depth H of the cone-shaped depression in (b) of FIG. 17 are 4 μm to 17 μm. A maximum width W of the cylinder-shaped depression in (a) of FIG. 17 and a maximum width W of the cone-shaped depression in (b) of FIG. 17 are 30 μm to 78 μm.

When the width of the transverse barrier ribs a1 and d1 or the width of the longitudinal barrier ribs a2 and d2 in FIG. 16 is, for example, 50 μm to 60 μm, the maximum depth of the depression may be 0.067 to 0.34 times the width of the transverse barrier ribs a1 and d1 or the width of the longitudinal barrier ribs a2 and d2.

Further, the depression has to be spaced apart from an edge of the barrier rib by a predetermined distance so as to prevent the breaking of the barrier rib. The maximum diameter of the depression may be 0.5 to 1.56 times the width of the transverse barrier ribs a1 and d1 or the width of the longitudinal barrier ribs a2 and d2.

The foregoing embodiments and advantages are merely exemplary and are not to be construed as limiting the present invention The present teaching can be readily applied to other types of apparatuses. The description of the foregoing embodiments is intended to be illustrative, and not to limit the scope of the claims. Many alternatives, modifications, and variations will be apparent to those skilled in the art.

The invention claimed is:

1. A plasma display panel comprising:

a front substrate;

a rear substrate positioned opposite the front substrate; and a barrier rib that is positioned between the front substrate and the rear substrate to partition discharge cells, the barrier rib including a transverse barrier rib and a longitudinal barrier rib crossing each other, wherein depressions are positioned to be spaced apart from each other at a barrier crossing of the transverse barrier rib and the longitudinal barrier rib wherein a maximum depth of the depression is 0.067 to 0.34 times a width of the barrier rib.

2. The plasma display panel of claim 1, wherein the depressions are positioned inside the barrier crossing.

3. The plasma display panel of claim 1, wherein when the transverse barrier rib is defined as a barrier rib partitioning the discharge cells coated with a phosphor of the same material, a height of the transverse barrier rib is smaller than a height of the longitudinal barrier rib.

4. The plasma display panel of claim 1, wherein the discharge cell has a rectangular plane.

5. The plasma display panel of claim 1, wherein the barrier rib includes an active barrier rib in an active area capable of representing a gray level and a dummy barrier rib in a dummy area positioned outside the active area, wherein the barrier crossing is a crossing of a transverse barrier rib and a longitudinal barrier rib of the dummy barrier rib and wherein an outermost portion of the dummy barrier rib includes a depression depressed in a direction of the active area.

6. The plasma display panel of claim 1, wherein the depression is formed by partially depressing an upper portion of the barrier crossing.

7. The plasma display panel of claim 1, wherein a maximum depth of the depression is 4 μm to 17 μm.

8. The plasma display panel of claim 1, wherein a maximum section of the depression is spaced apart from an edge of the barrier rib by a predetermined distance.

9. The plasma display panel of claim 1, wherein a maximum diameter of the depression is 30 μm to 78 μm.

10. The plasma display panel of claim 1, wherein a shape of the depression is a cylinder or a cone.

11. The plasma display panel of claim 1, wherein a plane shape of the depression is a circle, an oval, or a polygon.

12. A plasma display panel comprising:

a front substrate;

a rear substrate positioned opposite the front substrate; and a barrier rib that is positioned between the front substrate and the rear substrate to partition discharge cells, the barrier rib including a transverse barrier rib and a longitudinal barrier rib crossing each other, wherein depressions are positioned to be spaced apart from each other at a barrier crossing of the transverse barrier rib and the longitudinal barrier rib, wherein a maximum diameter of the depression is 0.5 to 1.56 times a width of the barrier rib.

13. The plasma display panel of claim 12, wherein the depressions are positioned inside the barrier crossing.

14. The plasma display panel of claim 12, wherein when the transverse barrier rib is defined as a barrier rib partitioning the discharge cells coated with a phosphor of the same material, a height of the transverse barrier rib is smaller than a height of the longitudinal barrier rib.

15. The plasma display panel of claim 12, wherein the discharge cell has a rectangular plane.

16. The plasma display panel of claim 12, wherein the barrier rib includes an active barrier rib in an active area capable of representing a gray level and a dummy barrier rib in a dummy area positioned outside the active area, wherein the barrier crossing is a crossing of a transverse barrier rib and a longitudinal barrier rib of the dummy barrier rib and wherein an outermost portion of the dummy barrier rib includes a depression depressed in a direction of the active area.

17. The plasma display panel of claim 12, wherein the depression is formed by partially depressing an upper portion of the barrier crossing.

18. The plasma display panel of claim 12, wherein a maximum depth of the depression is 4 μm to 17 μm.

19. The plasma display panel of claim 12, wherein a maximum section of the depression is spaced apart from an edge of the barrier rib by a predetermined distance.

20. The plasma display panel of claim 12, wherein a maximum diameter of the depression is 30 μm to 78 μm.

* * * * *